US011408716B2

(12) United States Patent
Thielen et al.

(10) Patent No.: US 11,408,716 B2
(45) Date of Patent: Aug. 9, 2022

(54) BULLET WITH IMPROVED AERODYNAMICS

(71) Applicant: Hornady Manufacturing Company, Grand Island, NE (US)

(72) Inventors: Joseph Thielen, Grand Island, NE (US); Jayden Quinlan, Grand Island, NE (US); Ryan Damman, Grand Island, NE (US)

(73) Assignee: HORNADY MANUFACTURING COMPANY, Grand Island, NE (US)

( * ) Notice: Subject to any disclaimer, the term of this patent is extended or adjusted under 35 U.S.C. 154(b) by 0 days.

(21) Appl. No.: 16/785,742

(22) Filed: Feb. 10, 2020

(65) Prior Publication Data

US 2020/0256656 A1 Aug. 13, 2020

Related U.S. Application Data

(60) Provisional application No. 62/804,257, filed on Feb. 12, 2019.

(51) Int. Cl.
*F42B 10/46* (2006.01)
*F42B 10/44* (2006.01)

(52) U.S. Cl.
CPC ..... *F42B 10/46* (2013.01); *F42B 10/44* (2013.01)

(58) Field of Classification Search
CPC ..... F42B 10/46; F42B 10/44
USPC ..... 102/519
See application file for complete search history.

(56) References Cited

U.S. PATENT DOCUMENTS

| | | | | |
|---|---|---|---|---|
| 10,101,137 | B2 * | 10/2018 | Burczynski | F42B 12/74 |
| 2006/0278117 | A1 * | 12/2006 | Emary | F42B 30/02 102/519 |
| 2012/0085258 | A1 * | 4/2012 | Emary | F42B 30/02 102/439 |
| 2016/0169645 | A1 * | 6/2016 | Emary | F42B 12/34 102/439 |
| 2016/0290774 | A1 * | 10/2016 | Langenbeck | F42B 5/025 |
| 2017/0205215 | A1 * | 7/2017 | Sloff | F42B 12/74 |
| 2018/0038673 | A1 * | 2/2018 | Fridlund | F42B 30/02 |
| 2018/0094911 | A1 * | 4/2018 | Fournier | F42B 12/74 |
| 2018/0195844 | A1 * | 7/2018 | Burczynski | F42B 12/72 |
| 2018/0224249 | A1 * | 8/2018 | Carbone | F42B 10/46 |
| 2018/0245896 | A1 * | 8/2018 | Burczynski | F42B 10/38 |
| 2019/0107372 | A1 * | 4/2019 | Liptaak | F42B 10/02 |
| 2019/0316888 | A1 * | 10/2019 | Thielen | F42B 12/78 |

* cited by examiner

*Primary Examiner* — Joshua E Freeman
(74) *Attorney, Agent, or Firm* — McHale & Slavin, P.A.

(57) ABSTRACT

A bullet with a blunt meplat with reduced drag coefficient relative to a non-blunt meplat with improved speed consistency during flight shot to shot.

9 Claims, 7 Drawing Sheets

BULLET WITH IMPROVED AERODYNAMICS

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 62/804,257, entitled "BULLET WITH IMPROVED AERODYNAMICS", filed Feb. 12, 2019. The contents of the above referenced application are incorporated herein by reference in its entirety.

FIELD OF THE INVENTION

A bullet with improved consistency of aerodynamics during flight is provided.

BACKGROUND OF THE INVENTION

Bullets are well known in the art. A bullet is the projectile that is discharged from the barrel of a firearm such as a rifle. The bullet is driven into the rifled portion of a barrel by high pressure gas generated from the burning of a propellant (gun powder or powder), which is typically ignited by a primer, as is well known in the art. The term "bullet" is often used to incorrectly refer to a complete ammunition cartridge. A cartridge, as properly used, includes a case (or casing) that holds the propellant in an interior chamber. Propellant is often referred to as an explosive, but it is not technically an explosive since, if ignited unconfined, it simply burns. The case of a centerfire cartridge will have a primer pocket that holds a primer which is used to ignite the propellant by flame going through the flash hole. There are two types of primers and primer pockets for center fire cartridges, Berdan and Boxer. The most common primer used in the U.S.A. is the Boxer primer. A Boxer primed case allows for using a pre-fired case for reloading. The bullet is seated in the throat or open end of the case and held in place by friction, and perhaps crimping, of the open end of the case, usually into a cannelure.

As simple as shooting a bullet may sound, there is a large body of science regarding what is referred to as ballistics. Ballistics can be broken down into three main categories: internal ballistics, external ballistics, and terminal ballistics. Internal ballistics concerns itself with what happens during propellant burning in the barrel until the bullet is discharged from the barrel. External ballistics is the science regarding the flight of the bullet along its trajectory path. Terminal ballistics is the study of how the bullet behaves when it strikes the target, including the transfer of kinetic energy of the bullet to the target.

External ballistics is important in both precision (the ability of bullets to group tightly together) and accuracy (the ability of a bullet to hit a certain target on demand). Consistent bullet speed is important in achieving both precision and accuracy. The distance a bullet drops between the firearm and the target is determined principally by the bullet speed and the change in speed along its flight path to the target. There are two issues regarding speed. It is noted here that the industry uses the term velocity in this regard, rather than the term speed. Velocity is a vector quantity having both magnitude and direction. Speed is not a vector quantity, and thus only includes magnitude. Throughout this application, the term "speed" will be used contrary to the industry practice. Bullet speed is determined by many factors, including primer, amount and type of propellant, rifling twist rate, bullet weight, barrel length, and bullet ballistic coefficient. Initial speed and change in speed determine flight time at a given distance, and flight time determines bullet drop; the faster a bullet, the less it drops over a given distance. Consistency in speed along the bullet flight trajectory from shot to shot is thus important in consistent drop, particularly over long distances, say 400 yards or greater. According to published data, a 308 Winchester cartridge shooting a 178 grain (gr) bullet with a muzzle velocity (speed) of 2600 feet/second (fps) zeroed at 200 yards has a drop of 25.2" at 400 yards and a drop of 50.2" at 500 yards. A similar cartridge shooting a 168 grain (gr) bullet with a muzzle velocity (speed) of 2670 fps zeroed at 200 yards has a drop of 24.8" at 400 yards and 50.0" at 500 yards. The drops are almost identical, even though muzzle speeds are different. This similarity in drop for different speeds can be attributed to the slower bullet having a higher ballistic coefficient, and thus not slowing down as much as the initially faster bullet. Additionally, bullet speed change during flight is affected by environmental conditions such as temperature, altitude, humidity etc., as is well known in the art.

Once the bullet leaves a barrel, two forces begin to influence its flight or trajectory. The first is air resistance. The second is gravity. Whatever it's angle of departure and whatever it's muzzle speed, a bullet will lose speed from air resistance and lose height (elevation) non-linearly because of gravity. The trajectory of a bullet is parabolic when initially traveling generally horizontally.

Bullets are typically given a ballistic coefficient (BC). There is no such thing as an absolute and invariable ballistic coefficient. A ballistic coefficient can change with reference to the bullet speed and the environmental conditions. A ballistic coefficient is a measure of a bullet's relative efficiency and ability to overcome air resistance. Each bullet can be assigned a numerical value expressing this efficiency. The basis of this value is a ratio comparing the performance characteristics of a particular bullet against the known trajectory characteristics of a standard bullet model, such as a G1 or G7 standard. A ballistic coefficient is calculated not only with reference to a standard bullet, but with reference to standard test conditions as well. Standard conditions are a temperature of 59° F., an actual atmospheric pressure of 29.92" of mercury, and a relative humidity of 50%. Equations for calculating trajectory and performance are available and take into account any change in these conditions.

While a ballistic coefficient is useful in evaluating one bullet relative to another bullet, it is not an absolute property of the bullet, but a relative property. In fluid flow, a more useful and scientific property of the bullet is its drag coefficient.

The drag coefficient is $C_d=2F_d/\rho V^2A$, where $C_d$ is the drag coefficient, $F_d$ is the drag force (which changes with speed), $\rho$ is fluid density, V is velocity (speed), and A is the cross-sectional area of the object transverse to the direction of travel. Drag force on an object is proportional to the density of the fluid and proportional to the square of the relative flow speed between the object and the fluid. $C_d$ is not a constant, but can vary as a function of flow speed, and other variables. For certain body shapes, the drag coefficient only depends on the Reynolds number, Mach number (speed relative to the speed of sound), and the direction of the flow. Also, at low Mach numbers, drag coefficients can change rapidly with speed changes. At subsonic speeds, the Mach number is relatively constant. A typical rifle bullet speed at the muzzle is between about Mach 2 and about Mach 3. Of course, the bullet speed decreases as the bullet moves from the muzzle to the target, particularly for rifle shooting where the target can be hundreds of yards away.

Bullet speed is thus an important variable in trajectory and, in particular, bullet drop, since under a given set of environmental conditions, it tends to be a major variable that is changing during a shooting event. This is particularly important for long range rifle shooters.

The drag coefficient, as used herein, is measured at supersonic, transonic and subsonic speeds along the flight path, and is measured using a Doppler radar antenna, Infinition BR 29015, using software Infinition Test Center 6.3.1. This package provides a drag coefficient throughout the various speeds of flight.

DESCRIPTION OF THE PRIOR ART

The physical shape of a bullet (projectile) and the details of its parts are the main influences on the measured shape drag of a given bullet. The shape of bullets has changed over the decades to become more effective in reaching a target. For example, round nose bullets have been the choice of many large game hunters because of the impact deceleration effected by the round nose. Pointed bullets have also been designed and improved to provide a higher ballistic coefficient or lower drag coefficient to improve speed retention during flight to the target. The shape of the forward end of the bullet has changed over the decades, as well as the trailing end of the bullet. For decades, the dimensions of the ogive, boat tail and meplat have been measured and correlated by multiple sources. These measurements have been used by bullet designers to purpose build bullets for specific uses. Current understanding of bullet features has mainly focused on the implications on the average or overall shape drag, but has not addressed the influence these features have on the variability of the shape drag, and hence speed variability along the flight path. A major goal of bullet design has been the achievement of higher ballistic coefficients rather than consistency of performance, particularly in the standard deviation of the drag coefficient from shot to shot. It has long been considered that the more pointed the bullet, the better the bullet. Higher ballistic coefficients serve a marketing purpose, as well as efficiency and terminal ballistic performance.

There are two basic categories of rifle bullets today, target and hunting, and then types of bullets in those categories. One type of bullet is the boat tail hollow point (BTHP), and another type of bullet is one with a formed tip that is inserted into a formed pocket. The BTHP type of bullet has a meplat at its forward end and has a longitudinally extending hollow pocket. Manufacturing processes, though, limit how small the meplat diameter can be, even though the meplat is flat because of the required pocket. Sometimes BTHP meplats are sloped, crooked, jagged, off center, etc., caused by the nature of the manufacturing process. The insert type formed tip, because of manufacturing processes, is often rounded.

The diameter of the meplat affects the overall drag of the bullet based on its size and shape. A smaller meplat produces a lower shape drag value ($C_d$—drag coefficient) than does a larger meplat diameter at higher Mach numbers (above approximately 1.5). This is reflected by the increase in ballistic coefficient (BC) that is observed when a BTHP (boat tail hollow point) design is pointed by reducing the meplat diameter. The resulting reduced drag benefit, however, is lost at lower Mach numbers (below approximately 1.5). FIGS. 4 and 5 illustrate this relationship of meplat diameter to overall drag for 6.5 mm and 7.62 mm caliber projectiles.

SUMMARY OF THE INVENTION

It is an objective of the present invention to provide a bullet that provides more consistent speed change along its flight path.

Accordingly, it is a primary objective of the present invention to provide a bullet that, as a group, will exhibit less standard deviation in drag coefficient change (shape drag) along its flight path from muzzle to target.

It is a further objective of the present invention to provide a bullet that, even though its design results in a higher drag coefficient, has improved speed consistency.

It is yet another objective of the present invention, which utilizes a blunt tip (meplat) having a diameter relative to the bullet caliber diameter to provide more consistent speed change during flight shot to shot.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
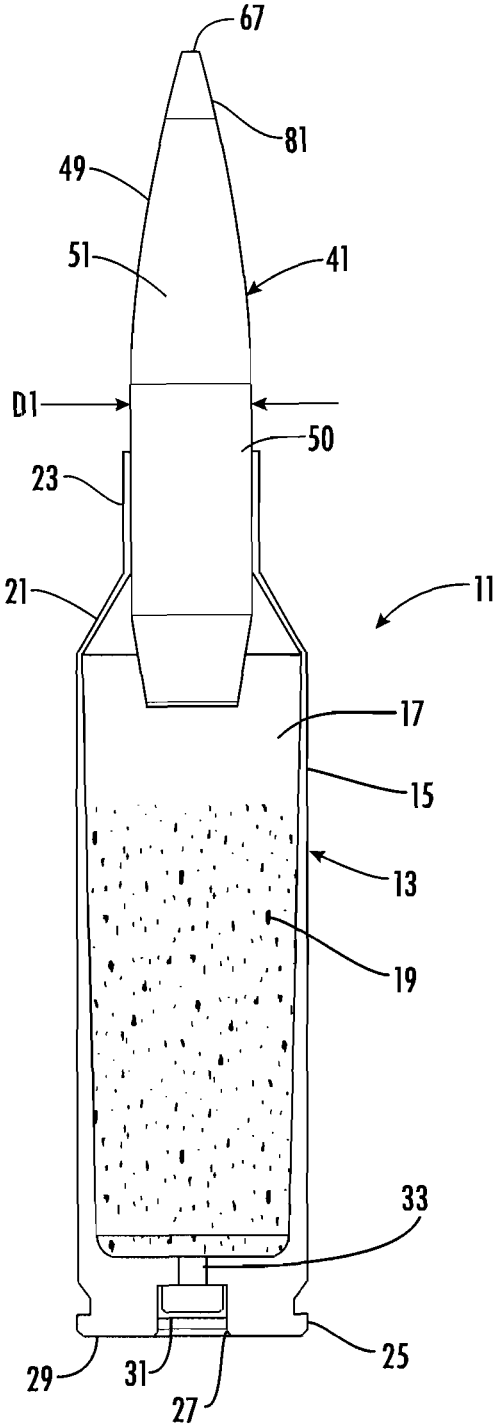
FIG. 1 is a longitudinal cross section view of a cartridge with a bullet.

FIG. 1 illustrates a centerfire rifle cartridge, designated generally 11, having a case (often also called a casing) 13 with a sidewall 15 partially defining an interior chamber 17 for holding propellant 19. While a necked down case 13 is illustrated, any suitable case can be used. The illustrated case 13 includes a shoulder 21 and a neck 23. The case 13 includes a base 25 having a primer pocket 27 opening onto the bottom 29 thereof. A primer 31 is positioned within the primer pocket 27 and has the ignition end thereof exposed to the flash hole 33, which provides a primer flame a path between the primer pocket 27 and the interior 17, whereby the flame from the primer 31, when initiated by the firing pin of a firearm (not shown) striking the primer 31, passes through the flash hole 33 and ignites the propellant 19. While the primer 31 and flash hole 33 are shown as a Boxer style primer, any suitable primer arrangement can be used. A bullet 41 is seated in the neck 23 of the case 13, and is held in place at least partially by friction. A cannelure (not shown, but well known in the art) can be provided on the exterior surface of the bullet 41, in which case the free end of the neck of 23 can be crimped and extend into the cannelure, as is known in the art, for additional securement of the bullet in the case 13. Many types of cases 13 are known in the art, and include the necked down type shown, straight wall, belted, rimmed, and rimless, etc. The present invention is not limited in use to a particular type of case 13. The bullet 41 has its forward end portion (also tip or nose) 49 extending beyond the open end 50 of the neck 23, as is known in the art. The forward end portion 49 is typically tapered and may be an ogive, or generally conical and provides streamlining for a high ballistic coefficient or low drag coefficient. A circumferential inwardly extending rib (not shown) can be provided inside the jacket 51 (described below), as known in the art, to help prevent separation of the core 55 from the jacket 51 during expansion of the bullet upon impact with a target if the bullet is of an expanding type designed to "mushroom" on impact, a so-called hunting bullet. Target bullets are not designed to upset on impact. It is, however, to be understood that all bullets can upset (deform or mushroom), some on impact, depending on target hardness. It is to be understood that the bullet 41 could be used in a muzzleloader that does not use a case 13 without departing from the scope of the invention. This invention is particularly useful with centerfire rifle cartridges having a bullet diameter (D1) in the range of between about 0.2" and about 0.51" and a muzzle velocity (speed) in excess of about 2000 fps. The inventive bullet is also important for speed control consistency when the bullet is traveling at a speed of less than 2000 fps downrange of the muzzle.

The bullet 41 is shown as a jacketed bullet. It has a jacket 51 that can be formed of a soft metal, such as a copper alloy, and can have the metal exposed on the exterior, or can be coated with a material such as molybdenum disulfide or hexagonal boron nitride (HBN). As used herein, the term "metal" can include both substantially pure metal and a metal alloy. The jacket 51 is preferably a copper alloy. The illustrated bullet 41 has a core 55 which is typically of a lead (including lead alloy) or other dense metal. A cannelure (not shown) is a groove formed in the jacket 51 and can be provided if desired. A portion of the jacket 51 defining the cannelure can extend into the core 55, locking the jacket 51 to the core 55. An inwardly extending rib (not shown) on the inside of the jacket 51 can also be provided to help lock the core 55 to the jacket 51. It is to be understood that the core 55 and jacket 51 can be a monolithic construction. In such a monolithic integral construction, the core portion and the jacket portion are made of the same material and thus homogeneous. Such a bullet is provided by Hornady and sold under the brand name GMX®. A lead alloy core jacketed bullet is the preferred embodiment of the present invention. The manufacture of jacketed and monolithic bullets and their component materials are well known in the art.

Figure 2:
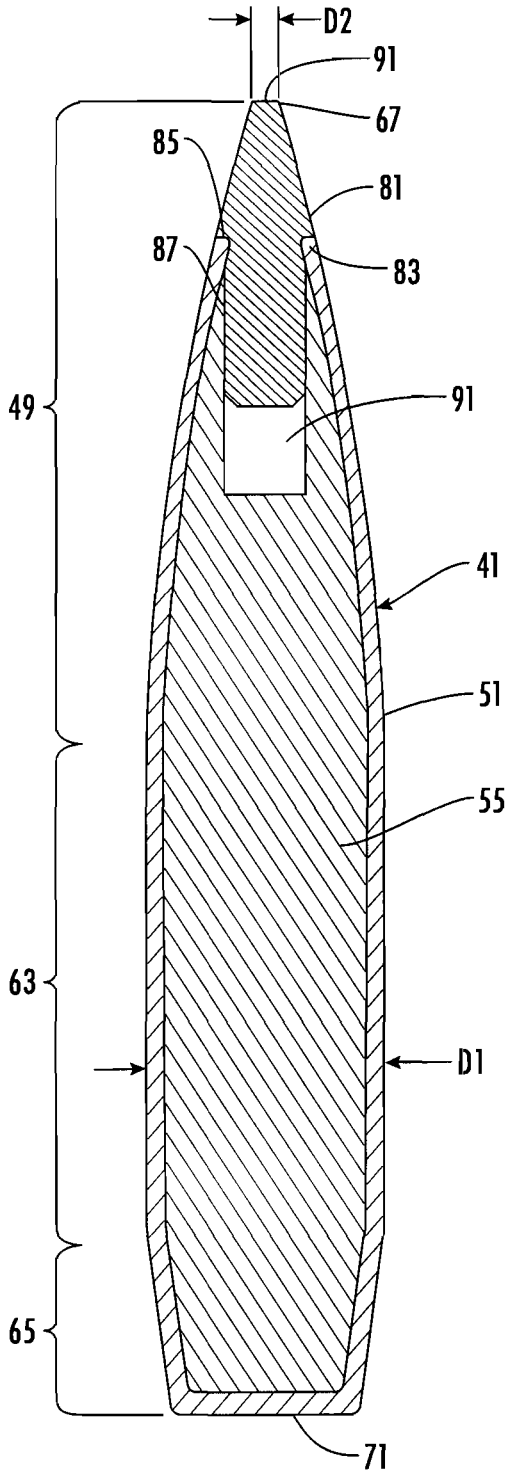
FIG. 2 is a longitudinal cross section of the bullet in FIG. 1.

The bullet 41, as seen in FIG. 2, can be divided into three portions. The tip or nose portion 49, the body portion 63, and the tail portion 65. The nose portion 49 will be contoured to provide streamlining or aerodynamic efficiency. Such a contour can be a secant ogive contour, a spire point, or other contour that provides an increasing diameter from the forward end or meplat 67 of the nose portion 49 to the body portion 63. The meplat 67 is the forward and leading end of the bullet 41 forward end of the nose portion 49 and is blunt as described herein. The meplat 67 faces the normal direction of travel of the bullet 41 along its flight trajectory. The body portion 63 will be generally cylindrical on its exterior surface, except for perhaps one or more cannelures therein. The shape of the tail portion 65 and nose portion 49 will affect the drag coefficient. The body has a diameter D1 that is also typically considered the caliber of the bullet. It is noted here that the stated caliber is not necessarily the bullet diameter. For example, a 30 caliber bullet has a diameter of 0.308" (within manufacturing tolerances). The body portion 63 is the portion of the bullet 41 that will engage the surface defining the bore of the barrel, notably the rifling including the lands and grooves as is known in the art. The tail portion 65 of the bullet 41 can be any suitable shape, such as a boat tail or a flat bottom. In the case of a flat base, the tail portion 65 would be flat, and perhaps the transition contour between the body section 63 and the bottom wall 71. Bullets of the aforementioned types are well known in the art.

In the illustrated embodiment, the bullet 41 includes a tip insert 81. The tip insert 81 can be molded or machined, and can be of a polymeric or elastomeric material. It could also be of a metal material. The side surface of the tip insert 81 can form part of the nose portion 49. The tip insert 81 includes a shoulder 83 that engages a leading end surface 85 of the jacket 51. A stem 87 of the tip 81 extends into an open end of the jacket 51 into a pocket 91 that is at least partially formed in the core 55. As shown, a portion of the pocket 91 is also present in the forward end of the jacket 51. Preferably, the stem 87 does not extend all the way to the bottom of the pocket 91, as best seen in FIG. 2. With the tip insert 81 engaging a hard target, the tip can move longitudinally into the pocket 91, preferably before engaging the forward end of the core 55. Such a construction limits the expansion of the bullet 41 upon impact. Such a bullet, as shown, is constructed to have low expansion and be used for target shooting. Other constructions can be provided for a hunting bullet version which would provide for greater expansion or mushrooming of the bullet upon target impact. Such constructions are well known in the industry. While the bullet 41 is shown as having an insert 81, it is to be understood that the bullet could also be machined to form the inventive bullet shapes and dimensions. Target bullets are not recommended for hunting because of their limited expansion. Military engagement rules prohibit use of expanding bullets.

It has been surprisingly found that blunting the meplat 67 (less pointed) improves performance of the bullet 41 while being less aerodynamic (higher drag coefficient). Traditionally, it has been believed that enhanced streamlining of the bullet's forward end (more pointed) improves bullet performance. The present invention proves this belief wrong, and tests support effectiveness of this invention. In the illustrated embodiment, the meplat 67 is the forward end of the tip insert 81, however, it is to be understood that the meplat 67 could be formed as part of the forward end of the jacket 51 and the tip insert 81 could be eliminated. Having a blunt meplat 67 provides improved performance, particularly regarding consistency of bullet speed on its flight path to the target after leaving the muzzle of the firearm, with all other cartridge characteristics being the same, for example, powder type and weight, type of primer, barrel length and twist rate. By controlling the shape and size of the meplat 67, the standard deviation for bullet speed along the bullet trajectory to the target is greatly improved. It was also surprisingly found that by controlling the size of the blunt meplat 67 in a ratio to the diameter D1 of the body portion 63, bullet trajectory to the target was greatly improved; this improvement has been found to exist across a wide range of bullet diameters. Regardless of a projectile's (bullet) initial and subsequent downrange Mach values, a projectile utilizing this invention reduces the standard deviation of velocity degradation when compared to existing projectiles that do not utilize the invention. See FIG. 6 as an example.

The variability in bullet speed, both at the muzzle and along its course to target, result in variable bullet drop, which affects precision and accuracy. While a sharp pointed meplat provides a lower overall drag at higher Mach numbers, it leads to a high drag variability from shot to shot, as found and improved upon by the present invention.

The inventive meplat 67 provides for a blunt tip that has a small diameter D2, but is blunt, contrary to the above discussion of bullets in the "Description of the Prior Art" section above. The meplat 67 has a diameter, described in more detail below, D2 in a ratio to the diameter D1, D2:D1 of 0.07:1 to 0.18:1 (for a 22 caliber, the meplat has a diameter in the range of 0.016" and 0.040", and a 50 caliber bullet meplat has a diameter in the range of 0.036" and 0.092"), and preferably 0.08:1 to 0.16:1. A benefit of the invention is that the inventive meplat does not appreciably change the drag coefficient of the same bullet with a pointed or rounded tip. It has been found that these dimensions, along with a blunt end on the bullet tip, allow for both a pointed bullet and low drag coefficient, but with a significantly improved standard deviation of drag coefficient than those with a round tip end. The drag coefficient values herein are measured using the above described radar antenna and software at standard conditions and at a bullet speed of Mach 2.5.

The bullets 41 are made in a manner that the diameter D2 is consistent across a series of sampled bullets. In a preferred embodiment, bullets 41 from a production run of bullets of the same denoted caliber, e.g. 30 caliber bullets, has at least 80%, and preferably at least 90%, of a sample of at least 10 bullets and preferably at least a 50 bullet sample with a diameter D2 varying no more than 0.010 inch, and preferably no more than 0.006 inch between the sampled bullets diameters D2.

Figure 3A:
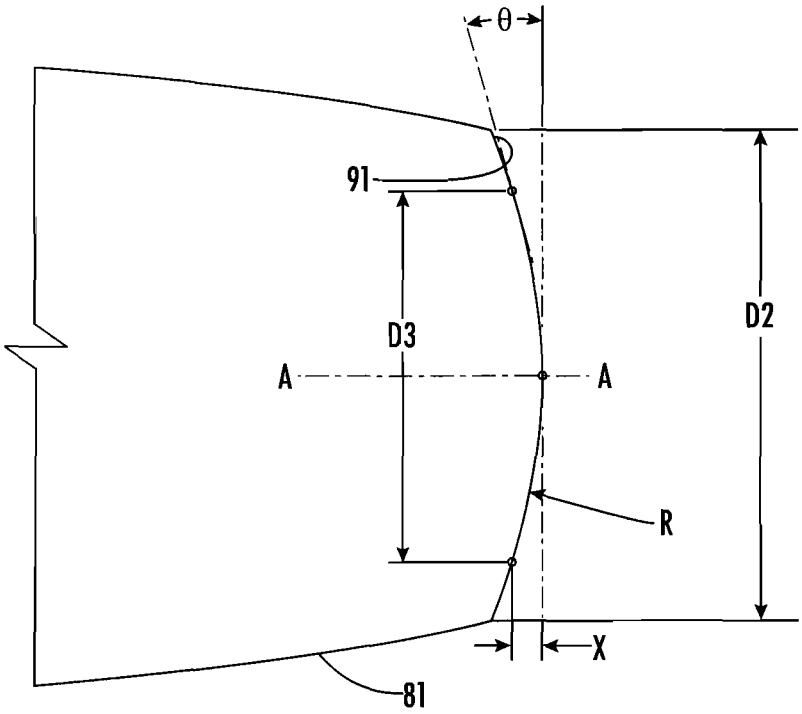
FIG. 3A is an enlarged fragmentary view of the bullet of FIG. 2 with a non-flat convex blunt meplat.
Figure 3B:
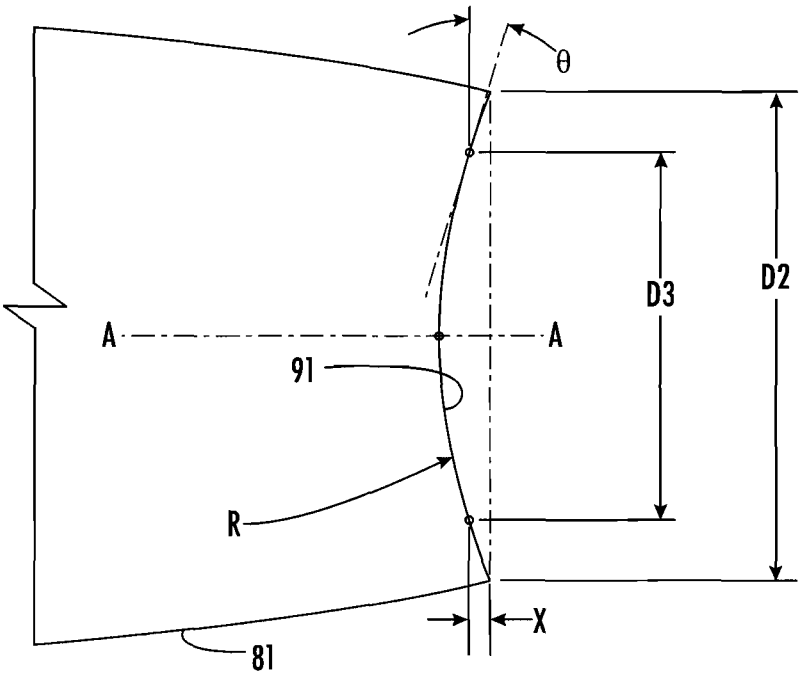
FIG. 3B is an enlarged fragmentary view of a bullet with a non-flat concave blunt meplat.

Referring to FIGS. 3A and 3B, the blunt face 91 of the meplat 67 is best seen for a rounded to flat meplat. As seen in FIG. 1, the meplat is part of a tip insert 81 which facilitates manufacture of the bullet 41. Blunt, for the purposes of this application, means for a rounded face 91 that R, the radius of the meplat of the face 91 within the diameter D3 is between infinity (i.e. flat) and 0.2 times the diameter D when the meplat is flat to convex. The angle θ is less than or equal to 30°, and dimension X is less than or equal to 0.02 times D1. The angle θ is that angle between a line perpendicular to the axis A-A and a line tangent to face 91 at the point where D3/2 intersects face 91, as seen in FIGS. 3A and 3B. D3 is the diameter across the face 91 at the two dimensions X from the line perpendicular to the central axis A-A at the center of the meplat between a transverse plane perpendicular to the axis A-A and a line from a point at the distance D2/2 to the center axis A-A. This means that the face 91 could be slightly contoured, for example, slightly rounded, or slightly pointed and convex or concave.

Figure 3C:
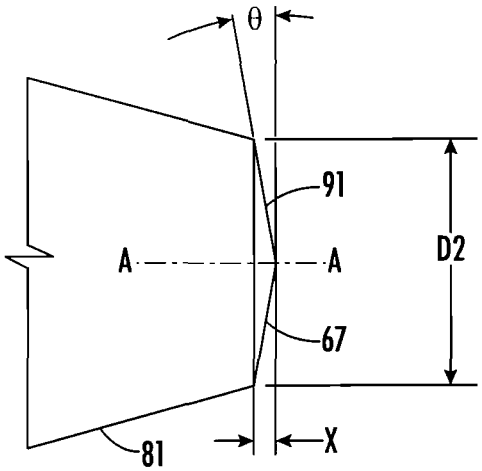
FIG. 3C is an enlarged fragmentary view of a bullet with a convex, generally conical, meplat.
Figure 3D:
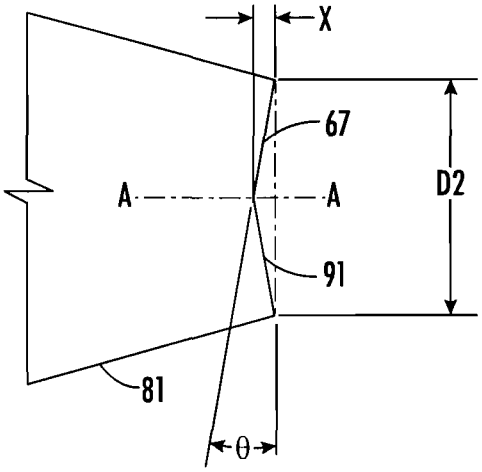
FIG. 3D is an enlarged fragmentary view of a bullet with a concave, generally conical, meplat.
Figure 4:
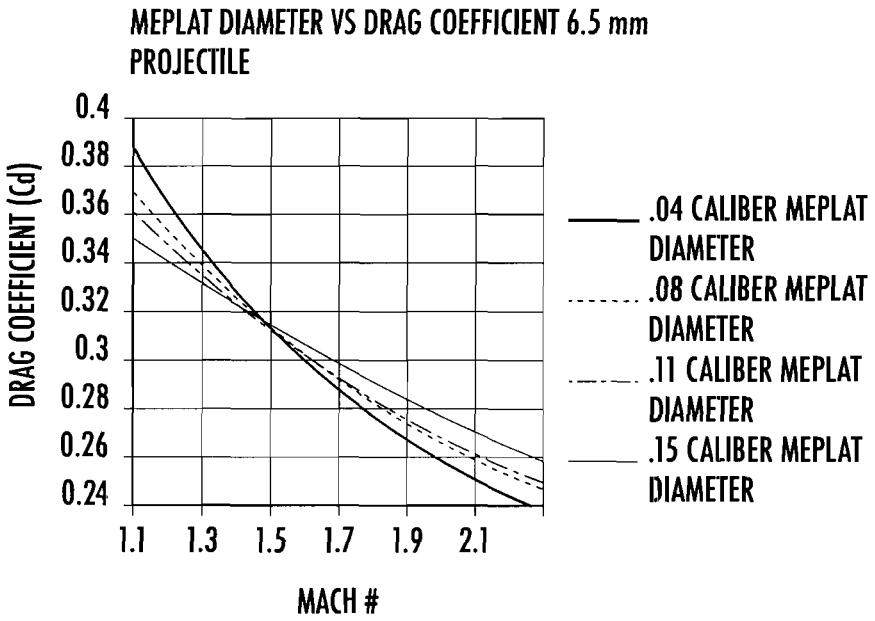
FIG. 4 is a graph showing drag coefficient as a function of Mach number for various meplat diameters for a bullet with a caliber diameter of 6.5 mm.
Figure 5:
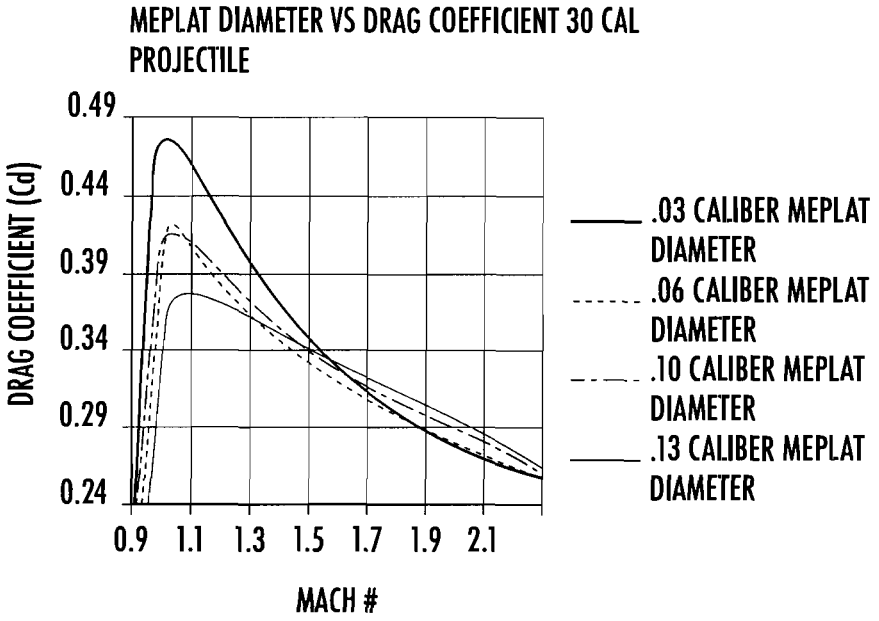
FIG. 5 is a graph showing drag coefficient as a function of Mach number for various meplat diameters for a bullet with a caliber diameter of 7.62 mm (30 caliber)

FIGS. 3C and 3D show a meplat 67 with a generally conical face 91. In this case, an angle θ of 300 or less will suffice to provide a blunt face 91 regardless of the dimension X.

It is to be understood that while the illustrated bullet 41 is shown as having a tip insert 81, the bullet 41 could be formed with the jacket and its forward end forming the meplat 67. In a preferred embodiment, the tip insert 81 is formed of a metal material and, alternately, could be formed as a polymeric material if desired. A desirable material is aluminum (including aluminum alloys).

Figure 6:
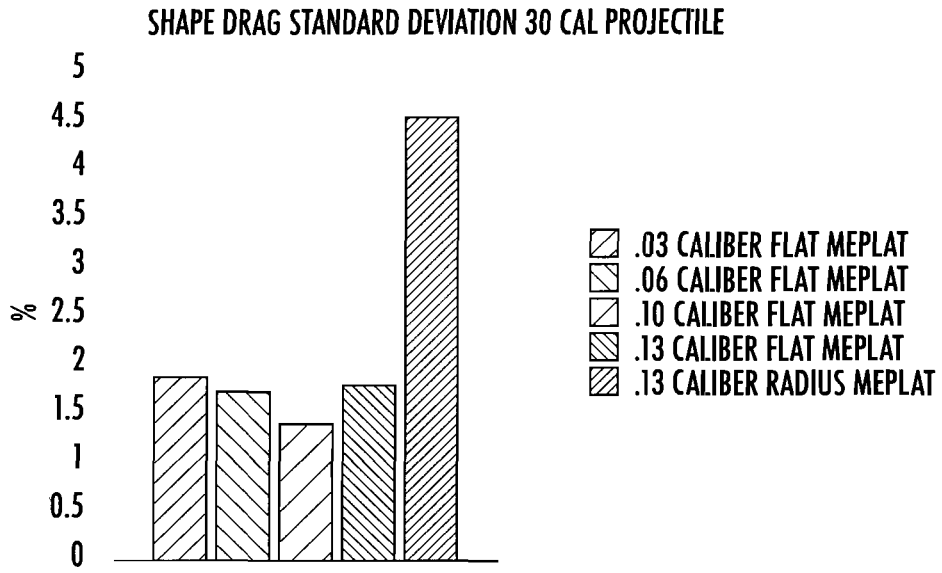
FIG. 6 is a bar chart showing shape drag standard deviation in bullet speed for various meplat diameters of a bullet with a caliber diameter of 7.62 mm (30 caliber)

Experiments utilizing the herein described Doppler radar testing procedure have shown that the meplat diameter affects overall drag (ballistic coefficient and drag coefficient) of the bullet. It has also been found that the shape of the meplat leading end surface is also important. The radius that is commonly utilized on a polymer tipped bullet has the same drag benefits of a small meplat diameter, such as is achieved by pointing a BTHP bullet or a lathe turned bullet utilizing a sharp point meplat. Experiments using the Doppler radar test described herein show that the shape of the meplat affects both the overall drag, and also the variability of speed shot to shot along the bullet trajectory. That is, the standard deviation of speed is surprisingly reduced by utilizing the herein described meplat, providing for greater long-range precision and accuracy. As seen in FIG. 6, standard deviation of speed using the herein described meplat is reduced. FIG. 6 represents the standard deviation of generally at least 10 shots per trial, with standard tolerances on powder weight, case, size, etc., expressed as a percentage of the overall drag. As seen, a radiused tip shape results in more drag variability when compared to the inventive meplat described herein. Tests were conducted at an outdoor range over a 2,400 yard distance using the herein described drag coefficient test method.

Figure 7:
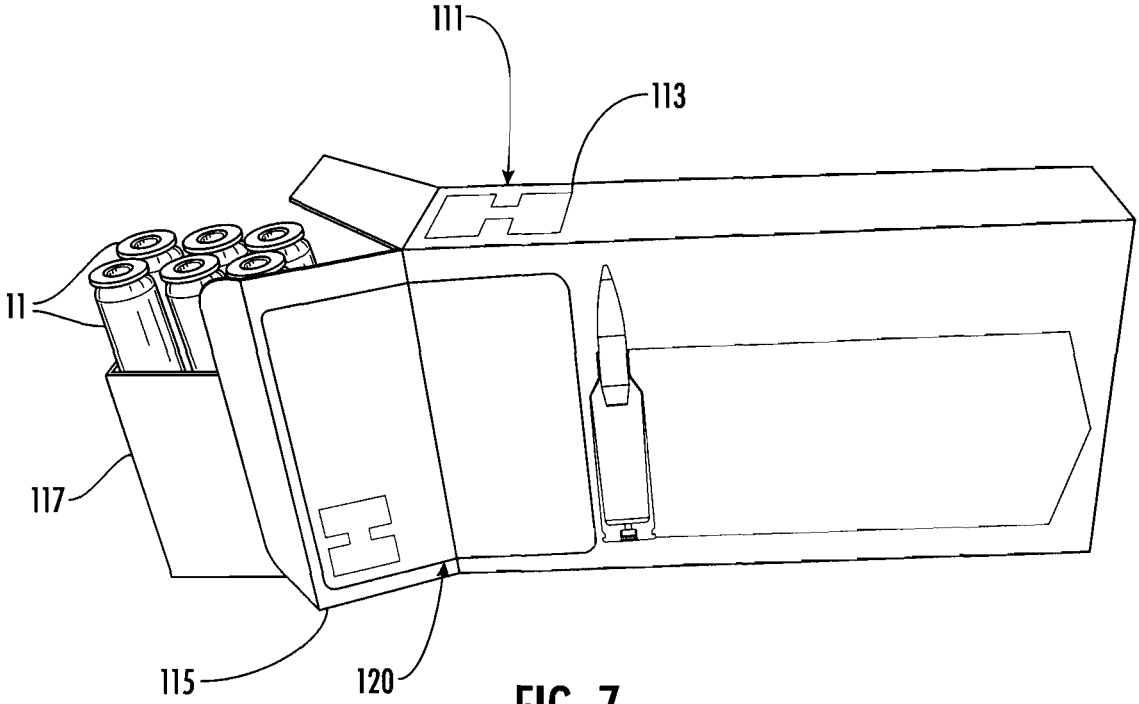
FIG. 7 is an isometric view of loaded cartridges in a consumer package.

FIG. 7 shows a consumer package 111 of cartridges 11 as described above. The package includes an outer container 113, which is typically a paperboard box having at least one closure flap 115 that can be an end flap or top flap. The package 111 includes a cartridge holder/separator 117 removably positioned in the interior of the container 113 and removably contains a plurality of cartridges 11. Preferably, the package will contain at least 5, more preferably at least 10, and most preferably at least 20 cartridges 11, each with the above described meplat 67. The package 111 also includes indicia 120 on its exterior that will include one or more brand names, such as Hornady®, quantity, bullet line designation, which can be a brand name such as SST® or Interbond®, or bullet/cartridge type such as match or cartridge type and caliber such as 308 Winchester, bullet weight, and marketing information including a description of the meplat and its advantages.

Figure 8:
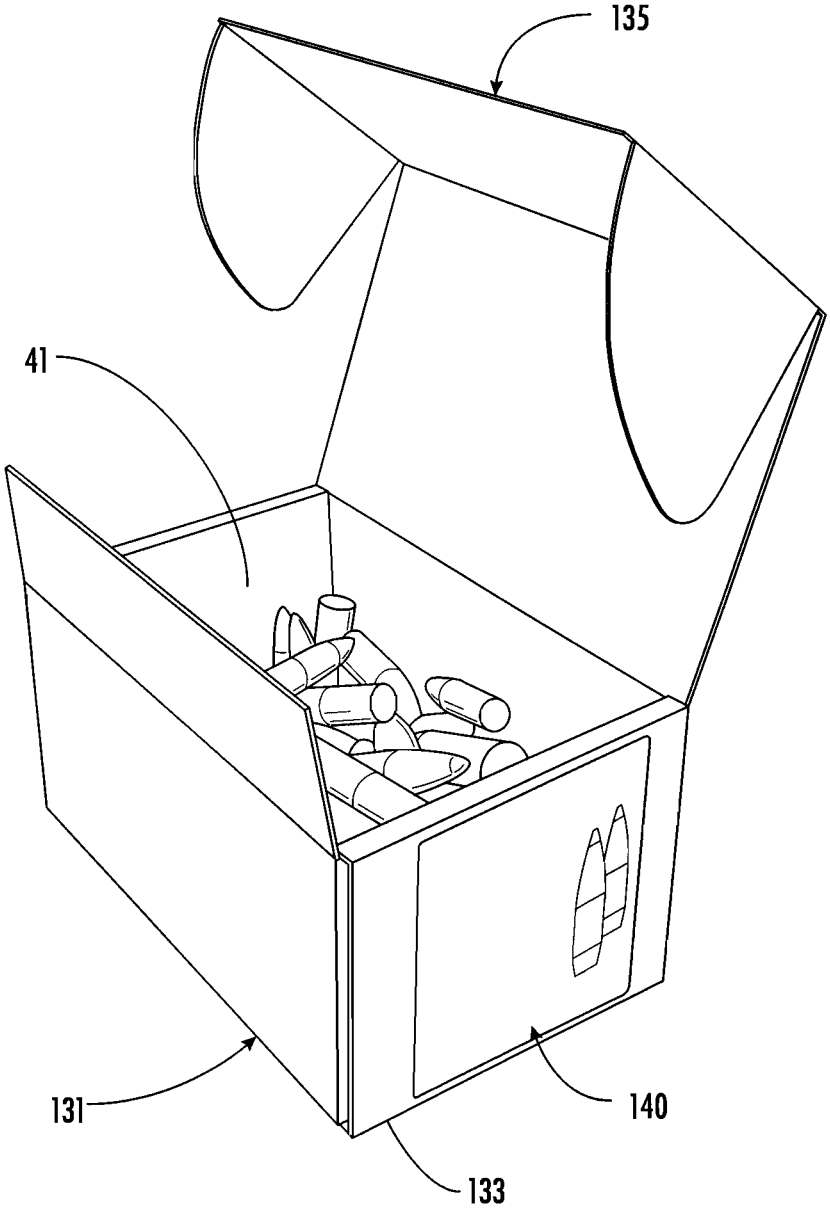
FIG. 8 is an isometric view of bullets in a consumer package.

FIG. 8 shows a consumer package 131 of bullets 41 as described above. The package 131 includes an outer container 133, which is typically a paperboard box having at least one closure flap 135 that can be an end flap or top flap. The package 131 can include an inner container, like a polymeric bag (not shown), removably positioned in the interior of the container 133 and removably containing a plurality of bullets 41. Preferably, the package will contain at least 10, more preferably at least 20, and most preferably at least 50 bullets each, with the above described meplat 67. The package 131 also includes indicia 140 on its exterior that will include one or more brand names such as Hornady®, quantity, bullet line designation, which can be a brand name such as SST® or Interbond®, or bullet type such as match or cartridge type and caliber such as 30 caliber/308, bullet weight, marketing information, and a description of the meplat and its advantages.

It is to be understood that marketing information can be provided separately from the packages 111 and 131 and associated with the inventive bullet 41 to provide information about the inventive bullet and its advantages over other bullets and cartridges. Such marketing information can be provided in advertising materials like magazine ads, internet material, and media, such as television and radio ads.

All patents and publications mentioned in this specification are indicative of the levels of those skilled in the art to which the invention pertains.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A bullet for use to form a cartridge usable in a firearm, the bullet comprising:

a bullet having a nose portion, a body portion and a tail portion with the body portion having diameter of at least about 0.2 inches, the nose portion including a tip insert secured directly to a cavity in the body portion of the bullet forming the leading surface of the bullet, the tip insert constructed from a metal material that is different than the metal material constructing the bullet, the tip insert including a meplat and the nose portion increasing in diameter from the meplat toward the body portion, the meplat being a blunt surface, the blunt surface being substantially flat having a deviation from flat defined as less than or equal to 0.02 times the body portion diameter D1 and extending radially outwardly to and intersecting with an outside diameter surface of the nose portion, said meplat having a first diameter D2 and the body portion diameter D1 with the ratio of the first diameter to the second diameter being in the range of between about 0.07:1 and about 0.18:1.

2. The bullet of claim 1 wherein the ratio of the first diameter to the second diameter being in the range of between about 0.08:1 and about 0.16:1.

3. The bullet of claim 2 wherein the second diameter is in the range of between about 0.2 inches and about 0.51 inches.

4. The bullet of claim 3 wherein the metal constructing the tip insert is aluminum or aluminum alloy.

5. The bullet of claim 3 wherein the bullet is seated in a case; the case containing propellant and having a primer pocket with a seated primer.

6. The bullet of claim 3 wherein the body portion and tail portion of the bullet having a jacket formed from a first metal and a core constructed from a second metal.

7. The bullet of claim 6 wherein the tip insert includes a shoulder portion and a stem portion, the shoulder resting against the jacket metal and the stem secured within the core metal.

8. The bullet of claim 3 wherein the body portion and tail portion of the bullet being constructed from a monolithic metal.

9. The bullet of claim 3 wherein the tail portion of the bullet being a boat tail.

* * * * *